United States Patent [19]

Wallace et al.

[11] 4,411,706

[45] Oct. 25, 1983

[54] METHOD AND APPARATUS FOR ELIMINATING DUST FROM INK JET PRINTERS

[75] Inventors: Harry L. Wallace, Livonia; John D. Thomas, Plymouth, both of Mich.

[73] Assignee: Burroughs Corporation, Detroit, Mich.

[21] Appl. No.: 277,277

[22] Filed: Jun. 25, 1981

[51] Int. Cl.[3] ..... B08B 5/00

[52] U.S. Cl. ..... 134/37; 15/316 R; 346/25

[58] Field of Search ..... 134/37; 15/316 R; 98/36; 346/25, 75, 140 PD; 239/112, 290

[56] References Cited

U.S. PATENT DOCUMENTS

| | | | |
|---|---|---|---|
| 2,373,595 | 4/1945 | Peeps | 239/290 |
| 3,332,623 | 7/1967 | Gallant | 239/290 X |
| 4,036,434 | 7/1977 | Anderson et al. | 239/112 X |
| 4,083,932 | 4/1978 | Muraco et al. | 239/290 X |
| 4,200,232 | 4/1980 | Fraley et al. | 239/112 |

*Primary Examiner*—Richard V. Fisher

*Attorney, Agent, or Firm*—Delbert P. Warner; Kevin R. Peterson

[57] ABSTRACT

Method and apparatus for preventing dust, which developes in document handling machines, from accumulating in the orifices of associated ink jet printers and clogging them, includes disrupting the path of dust laden air to prevent it from flowing near the orifices where dust would be deposited. In a preferred embodiment, a counterflow of air from a fan is directed against the dust laden air to disrupt its flow and cause the dust to be carried away from the orifices.

4 Claims, 5 Drawing Figures

METHOD AND APPARATUS FOR ELIMINATING DUST FROM INK JET PRINTERS

FIELD OF THE INVENTION

The invention relates to document handling machines embodying ink jet printers and the like and particularly to means for improving the performance of ink jet printers in the environments associated with such machines. The invention has particular application to the reduction of problems associated with dust from paper which is generated when paper documents are moved along a transporter track through a document processing machine. The invention relates further to a system for altering air flow in the document track in such a way that dust carried along with the documents is suspended in the air in a fashion which prevents it from settling in and around the orifices of the ink jets and clogging them.

DESCRIPTION OF THE PRIOR ART

Ink jet printers, and particularly those of the drop-on-demand type, which are of special interest with the present invention, depend for reliability on the maintenance of clean jet heads and particularly clean orifices so that droplets of ink can be readily produced on demand. In the usual configurations for ink jet heads, several orifices are provided in an array and droplets of ink are shot out of selected orifices to produce patterns of dots representing desired characters. To clean the heads, wipers are provided which are moved across the openings of the orifices to wipe them clean between times when ink droplets are being produced. In the usual "clean" environments, the wipers generally operate efficiently to remove any small particles such as dust, which might otherwise accumulate around the orifices.

In the environment to which the present invention has application, large numbers of documents, on the order of 40,000 to 100,000 per day or more are moved along a pathway. In order to align these documents properly so that they may be "read" by character reading machines, they must be moved along in contact with metal guides lining the sides and the bottom of the pathway. Motion along these guides produces wear on the documents which is associated with the formation of dust. After several thousand documents have passed along the path there is a build-up of a substantial amount of dust along the pathway, some of which is picked up by the following documents and carried to the vicinity of the orifices in the ink jet printer head. Due to some mechanism of air flow which is not fully understood, as the documents pass the orifices, some orifices, some of the dust will be picked up and carried to the ink jet heads where some of it will adhere to the surface in and around the orifices. For a time, the wiper will successfully clean off the accumulation of dust and dust mixed with ink. Eventually, however, the wipers will become contaminated with a mixture of ink and dust and from time-to-time some of the mixture will be moved into positions obstructing one or more of the orifices as the wipers attempt to wipe them clean. The desired ink drops will not flow properly then from the obstructed orifice or orifices and characters will be formed with parts missing or with ink dots badly misplaced.

The use of an ink jet head of the kind employed in a preferred embodiment of the invention is described in a copending U.S. patent application Ser. No. 145,779 filed May 2, 1980 (issued Aug. 24, 1982 as U.S. Pat. No. 4,346,393) in the names of Harry L. Wallace and John M. Chambors entitled "Matrix Printer Employing A special Character Font" and assigned to the same assignee as the present application. A related U.S. patent application Ser. No. 145,780 was filed May 2, 1980 (issued Aug. 10, 1982 as U.S. Pat. No. 4,344,079) in the names of John M. Chambors and Harry L. Wallace entitled "System for Matrix Printing" and assigned to the same assignee as the present application. Both of those copending applications are incorporated by reference herein.

DESCRIPTION OF EXPERIMENTS PERFORMED IN ATTEMPTS TO REDUCE THE ACCUMULATION OF DUST ON INK JET NOZZLES

A number of different approaches have been made to reduce the accumulation of dust. Among them have been attempts to blow ionized air into the path near the nozzles to neutralize static charges on the dust particles. This approach has not proven to be very helpful, possibly because charges on the dust are not all of the same polarity and the ionized air is only effective in neutralizing charges on a fraction of the particles.

Other approaches have included provisions for directing a flow of air straight at the nozzles in the expectation that the dust would be blown away. This approach has included a single nozzle which was used experimentally to blow air at a number of angles against and near the face of the ink jet. Another arrangement involved the use of a pipe shaped like a horse collar with a series of openings through which air was blown from different angles, between a reference zero and over one hundred eighty degrees, against the face of the ink jet head. For some reason, none of the attempts to blow the dust away were sufficiently effective. Dust continued to accumulate at unacceptable rates.

In view of the lack of success with other systems, the present system for preventing dust from settling on the ink jet head has been developed. It involves the creation of turbulence in the air around the ink jet nozzle so that dust particles are kept away from the orifices of the jets, enabling check endorsers and the like to continue to function properly even after thousands of documents have been processed and the associated accumulated dust would otherwise clog the orifices.

Attention is directed to a related patent application which discloses a method and means for clearing ink jet heads of ink and dust which tend to accumulate despite the use of apparatus according to the present invention. This is U.S. patent application Ser. No. 277,276 filed of even date herewith (issued Dec. 7, 1982 as U.S. Pat. No. 4,362,572) in the name of Harry L. Wallace entitled "Method and Apparatus for Removing Trapped Dust and Air from Ink Jet Heads" which is assigned to the same assignee as the present invention and is hereby incorporated by reference.

BRIEF SUMMARY OF THE INVENTION

The invention relates to a method and apparatus for preventing dust from accumulating on ink jet printers so that the dust and mixtures of dust and ink are not available to be transported by the wiper to obstruct orifices of an ink jet printer. It relates particularly to a printer operated in a document handling machine to provide endorsements on documents processed by the machine.

Preferred embodiments employ a blower, or other source of air, assembled with a nozzle to provide a stream of air. Supporting means are provided to support the assembly in a manner such that the stream of air is directed along a path which causes turbulence in the air near the orifices of the ink jet nozzles. The turbulence drastically reduces the amount of dust which settles on the ink jet head.

DESCRIPTION OF A PREFERRED EMBODIMENT

Figure 1:
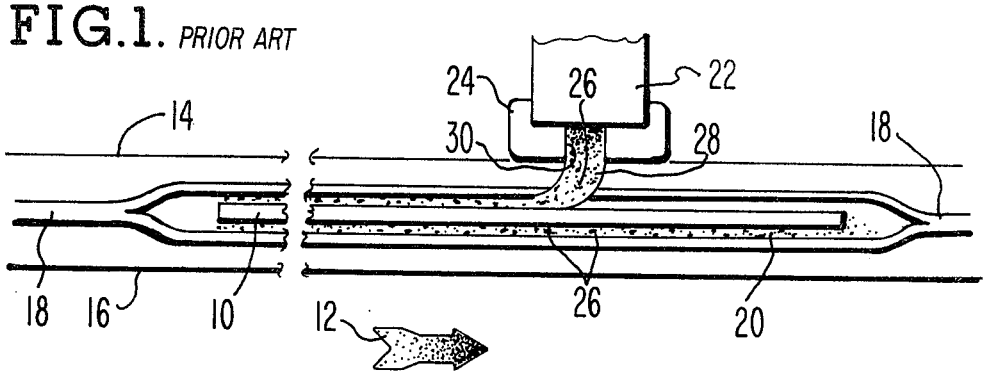
FIG.1. PRIOR ART
FIG. 1 is a schematic view showing relationships of apparatus employed in the prior art and particularly illustrating a path by which dust appears to be transferred from the surface and vicinity of a document to the jet head.

Turning to FIG. 1, a document such as a check is indicated at 10 to be moving in the direction of the arrow 12 between the walls 14 and 16 of the track in a document processor. Typically, the document will be moving at a speed of approximately 100 inches per second which causes air between the walls 14 and 16 to flow around the document as indicated at 18. This flow generally is around a layer of air which is held close to the body of the document, as indicated at 20, and moves with the document. The surface of the document 10 and the thin layer of air represented by 20 carry numerous particles of dust, represented by dots 26, along with the document. As the document passes the ink jet head 22 and the wiper 24 a certain amount of air at 28 from 20, carrying dust 26, is diverted into the opening in the face of the wiper 24 where dust lodges on the face of the ink jet head and in the orifices of the jets themselves.

As ink drops are shot out of the orifices of the jets, small amounts of ink will become mixed with the dust and a sort of slurry will form which will adhere to the ink jet head, the orifices of the jets and to the wiper. A portion of this slurry, because of its adhesive properties, will be carried back and forth by the wiper and eventually a portion of it will clog one or more of the orifices so that ink drops can no longer be fired out along the proper paths.

Figure 2:
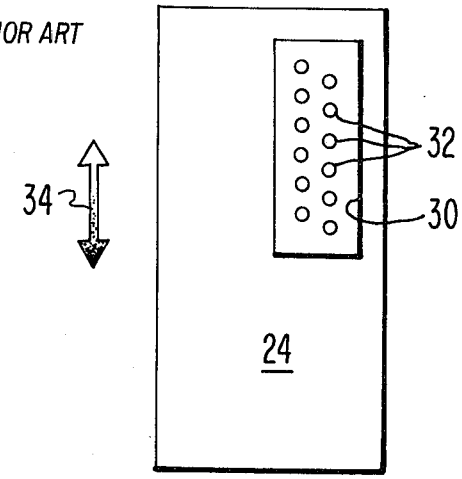
FIG.2. PRIOR ART
FIG. 2 illustrates relationships between the jet head and the wiper of an exemplary ink jet printer to which the invention has application.

FIG. 2 shows the face of an exemplary wiper at 24 with an opening at 30 through which twelve orifices 32 of an ink jet head may be seen. Dust 26 from the document 10 and the thin layer of air 20 will collect within the boundaries of the opening at 30 and within the orifices at 32. The wiper 24 moves up and down as indicated by the double arrow at 34 to wipe dust off the face of the jet head. Unfortunately, as previously indicated, with the amount of dust transmitted in the guidance channel of a document processing machine, the capacity of the wiper to clear off dust is soon exceeded. This is especially the case when the dust becomes impregnated with ink causing a wet adherent slurry to form which sticks to the wiper as it moves back and forth. It will be seen that the slurry will tend to collect in the orifices of the ink jet as the wiper moves back and forth which eventually interferes with the operation of the ink jet causing drops of ink to be diverted from their proper courses.

Figure 3:
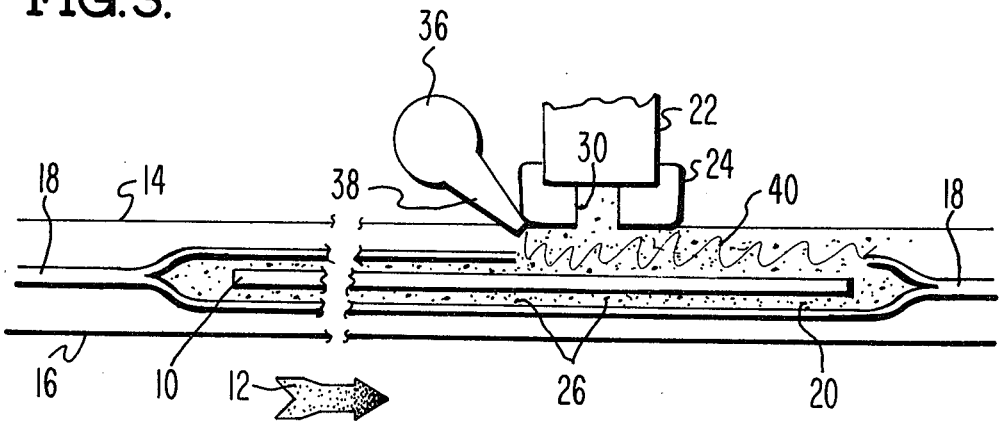
FIG. 3 is a schematic view illustrating how an air stream, introduced into the document path of a document processor, creates a turbulent air condition which blocks the path of dust to an ink jet head.

It has been discovered that the air flow at 28 with entrained dust particles 26 will be greatly reduced if an additional air supply is provided from a blower 36 as indicated in FIG. 3. In this example, air from the blower 36 and nozzle 38 is introduced into the channel to create a turbulent condition in the air between wall 14 and the document as indicated by the wavy lines 40. This turbulent air produces a force within the passageway which effectively diverts the air stream 28, with its entrained dust 26, away from the opening 30 and thus excludes most of the dust from being carried into the opening at 30.

In order to provide the dust eliminating effect, a blower at 36 is equipped with a nozzle 38 and the resulting air stream is aimed at the air stream 28 with its entrained dust 26. The air stream from the blower, which in a preferred embodiment has a speed of 2600–2900 feet per minute, breaks up the flow of the air stream 28 towards the opening 30 and thus reduces the flow of dust 26 into the jet head and the wiper. In a preferred embodiment, the nozzle will be positioned at an angle of forty-five to fifty degrees from a plane parallel to the direction of motion of a document in the transporter track.

Figure 4:
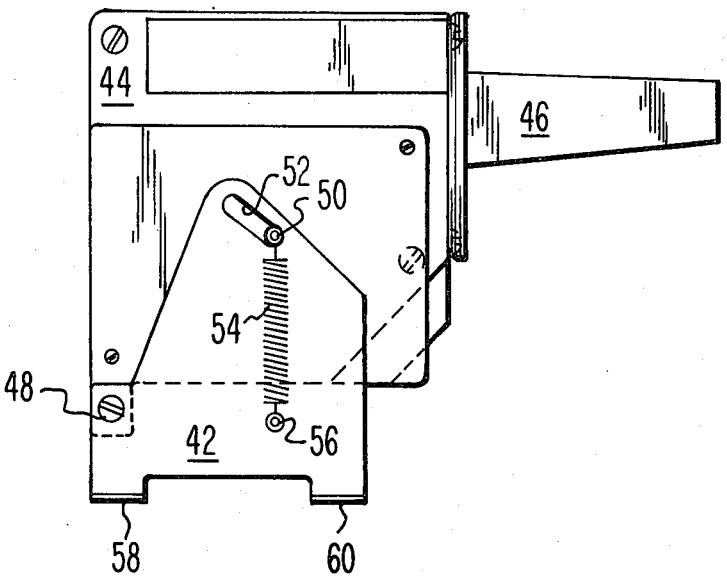
FIG. 4 is a side view of an assembly showing a fan in a housing, a nozzle and supports for the housing of the fan.
Figure 5:
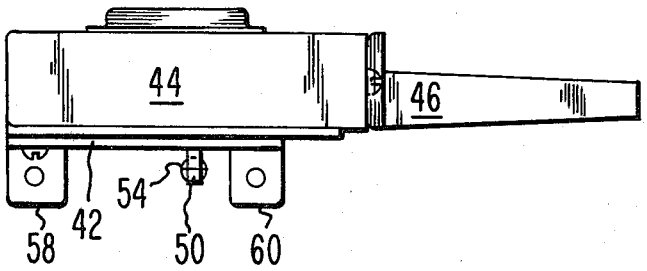
FIG. 5 is a top view of the assembly shown in FIG. 4.

FIG. 4 is a side view, and FIG. 5 a top view showing an assembly employed in a preferred embodiment of this invention. Plate 42 serves as the support for the body of a fan housed in housing 44 which provides air through attached nozzle 46.

The fan 44 is pivoted about a pin at 48 so that it may be rotated counterclockwise from the position shown to permit removal of the body of the ink jet printer head from the document handling machine. In a preferred embodiment, this rotation is restricted to the movement permitted by motion of a pin 50 in a slot 52. A spring at 54 extends between pin 50 and a pin 56 to positively bias the fan 44 to the rest position shown in FIG. 4. It will be seen that the feet 58 and 60 of plate 42 may be anchored by suitable means (not shown) to the docket handling machine.

What is claimed is:

1. In a document processing machine including an ink jet printer having an ink jet head and means for transporting documents along a dusty pathway toward the ink jet head, a system for reducing the effects of dust transported to the ink jet head by a dust impregnated air stream, comprising:

means for providing air under pressure;

an assembly including a nozzle coupled with said means for providing air to direct the air as a stream-of-air along a restricted path; and means supporting said assembly in a manner to aim said stream-of-air into the path of said dust impregnated air stream causing a turbulent condition which diverts a substantial part of the dust away from the ink jet head.

2. The invention as claimed in claim 1, in which:

the assembly is positioned in close proximity to the ink jet head; and the means supporting said assembly is pivoted whereby the assembly may be moved away from proximity to the ink jet head to enable removal of the ink jet head.

3. A method for preventing dust from accumulating on and around the jet head of an ink jet printer, where dust from a document processor is entrained in a first air-stream which carries the entrained air to the jet head, the method comprising:

generating a second air-stream;

controlling said second air-stream to cause the second air-stream to travel along a restricted path; and directing said second air-stream into the path of said first air-stream to produce a turbulent condition tending to disrupt the path of said first air-stream and divert the dust entrained therein away from the ink jet head.

4. The method of claim 3, comprising:

changing the position of apparatus employed in the production of the second air-stream;

whereby the ink jet head may be moved from a position near said apparatus.

* * * * *